US010694819B2

(12) United States Patent
Tseng

(10) Patent No.: US 10,694,819 B2
(45) Date of Patent: Jun. 30, 2020

(54) LUMINOUS SPRING BUCKLE DEVICE

(71) Applicant: Shen-Ko Tseng, Taipei (TW)

(72) Inventor: Shen-Ko Tseng, Taipei (TW)

( * ) Notice: Subject to any disclaimer, the term of this patent is extended or adjusted under 35 U.S.C. 154(b) by 19 days.

(21) Appl. No.: 16/269,355

(22) Filed: Feb. 6, 2019

(65) Prior Publication Data

US 2019/0246748 A1 Aug. 15, 2019

(30) Foreign Application Priority Data

Feb. 9, 2018 (CN) ..... 2018 1 0136421

(51) Int. Cl.

| | |
|---|---|
| ***A44B 11/16*** | (2006.01) |
| ***A44B 11/00*** | (2006.01) |
| ***A44B 11/25*** | (2006.01) |
| *A44B 11/06* | (2006.01) |

(52) U.S. Cl.

CPC ..... *A44B 11/16* (2013.01); *A44B 11/005* (2013.01); *A44B 11/2565* (2013.01); *A44B 11/06* (2013.01)

(58) Field of Classification Search

CPC ... Y10T 24/3984; A44B 11/16; A44B 11/005; A44B 11/2565; A44B 11/06; F16G 11/101; F16G 11/103

See application file for complete search history.

(56) References Cited

U.S. PATENT DOCUMENTS

2009/0173455 A1* 7/2009 Hartley ..... F21V 33/008 160/127

* cited by examiner

*Primary Examiner* — Robert Sandy

(57) ABSTRACT

A luminous spring buckle device includes a hollow casing, a luminous device, a spring and a bearing device. The hollow casing includes a bottom and an upper opening. The luminous device is positioned in the hollow casing and includes a controlling circuit and a luminous component. The spring is contained in the hollow casing. The bearing device is engaged with the upper opening in a sliding manner and coupled to the spring. Wherein, when an external force is applied to the bearing device, the bearing device compresses the spring and presses the controlling circuit to enable the luminous component to emit light. Compared with the prior art, the luminous spring buckle device includes the function of the spring buckle and luminous function to increase the recognizability and the night warning function.

16 Claims, 14 Drawing Sheets

LUMINOUS SPRING BUCKLE DEVICE

CROSS-REFERENCE TO RELATED APPLICATIONS

This application claims the priority benefit of Chinese Application Serial No. 201810136421.5 filed Feb. 9, 2018 the disclosure of which is incorporated herein by reference.

BACKGROUND OF THE INVENTION

1. Field of the Invention

The present invention relates to a spring buckle device, and more specifically, to a spring buckle device with luminous function.

2. Description of the Prior Art

The traditional way of fixing wire is intuitively associated with wire knotting. Although wire knotting is firm, it has the disadvantages that are not easy to unknot and are easy to get tighter while pulling. Especially, it is extremely inconvenient for some wires that need to be adjusted frequently, such as the ties of the pants, the drawstring of the clothes and the like.

The spring buckle is also called a tether buckle, a rope buckle, an adjustment buckle and the like. Compared with the knot, the spring buckle can easily adjust or fix the wire by the elasticity of the spring, and can be generally used for fixing the shoelace, the backpack drawstring or the tether fixed on the clothing. However, the spring buckles are usually small and the colors are mainly dark. In practical applications, they are not easy to attract attention, and even easily get lost.

SUMMARY OF THE INVENTION

For the above reasons, the present invention is to provide a luminous spring buckle device including a hollow casing, a luminous device, an elastic device and a bearing device. The hollow casing includes a bottom and a sidewall, and includes an upper opening and two side openings corresponding to each other. The luminous device is positioned in the hollow casing, and includes a controlling circuit and a luminous component. The controlling circuit is configured for activating the luminous device to enable the luminous component to emit light. The elastic device is contained in the hollow casing. The bearing device includes a through hole, and the bearing device is engaged in the upper opening in a vertically sliding manner and is coupled to the elastic device. When an external force is applied on the bearing device, the bearing device compresses the elastic device to cause the through hole and two side openings to form a passage that allows a rope to pass through, and the bearing device contacts the controlling circuit to activate the luminous device to enable the luminous component to emit light.

In practical applications, a portion of the rope is capable to be accommodated in the passage when the external force is applied, and the rope is clamped in the passage when the external force is removed and then the through hole is separated from the two side openings, which results in the decrease of the volume of the passage.

In one embodiment of the present invention, the bearing device includes two tenons and the two tenons are respectively configured in the side openings of the hollow casing in a sliding manner for limiting the bearing device to the upper opening of the hollow casing. When the external force is removed, the bearing device is lifted upwards and the tenons are blocked by the upper edge of the two side openings to limit the bearing device to the upper opening.

Compared with the prior art, the luminous device is configured inside the elastic device of the luminous spring buckle device of the present invention. When the user compresses the spring buckle, the bearing device compresses the controlling circuit of the luminous device to enable the luminous device to emit light. Compared with the conventional spring buckle, the luminous spring buckle device of the present invention retains the basic function of the spring buckle and adds the lighting function to increase recognizability. Moreover, the luminous spring buckle device further includes the safety warning function to increase the safety in the night.

BRIEF DESCRIPTION OF THE APPENDED DRAWINGS

DETAILED DESCRIPTION OF THE INVENTION

For the sake of the advantages, spirits and features of the present invention can be understood more easily and clearly, the detailed descriptions and discussions will be made later by way of the embodiments and with reference of the diagrams. It is worth noting that these embodiments are merely representative embodiments of the present invention, wherein the specific methods, devices, conditions, materials and the like are not limited to the embodiments of the present invention or corresponding embodiments.

Figure 1:
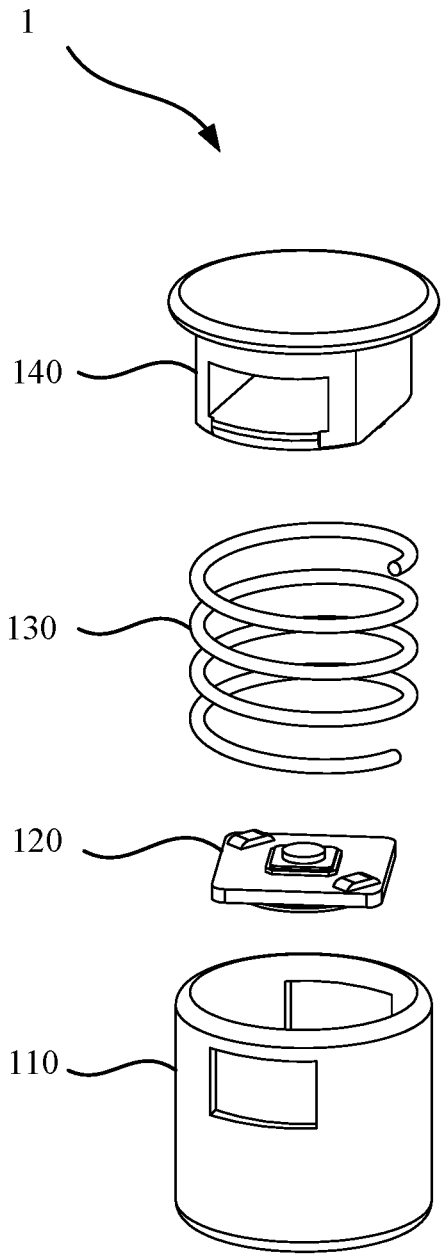
FIG. 1 is an exploded drawing illustrating a luminous spring buckle device according to the first embodiment of the present invention.

Please refer to FIG. 1. FIG. 1 is an exploded drawing illustrating a luminous spring buckle device 1 according to the first embodiment of the present invention. In the first embodiment, the luminous spring buckle device 1 of the present invention includes a hollow casing 110, a luminous device 120, an elastic device 130 and a bearing device 140. The luminous spring buckle device 1 is assembled by placing the luminous device 120 and the elastic device 130 into the hollow casing 110 first, and then inserting the bearing device 140.

Figure 2:
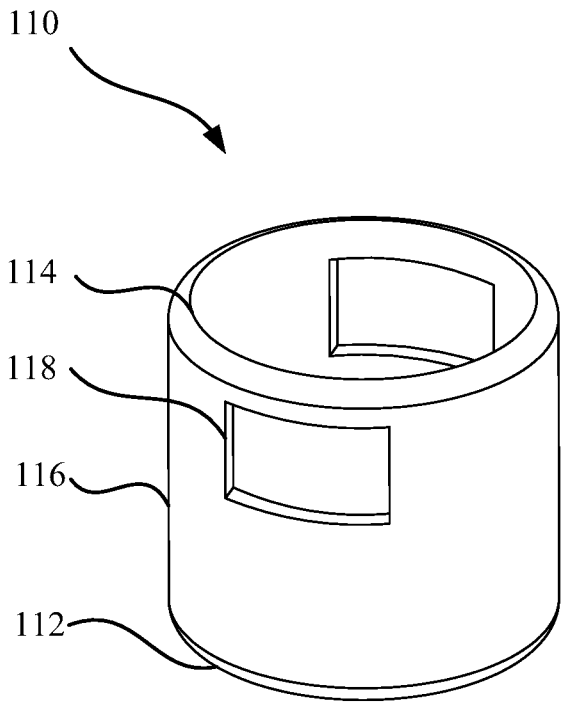
FIG. 2 is a schematic drawing illustrating a hollow casing of the luminous spring buckle device according to the first embodiment of the present invention.

Please refer to FIG. 2. FIG. 2 is a schematic drawing illustrating the hollow casing 110 of the luminous spring buckle device 1 according to the first embodiment of the present invention. In the first embodiment, the hollow casing 110 includes a bottom 112, a sidewall 116, an upper opening 114 and two side openings 118 corresponding to each other, as shown in FIG. 2. In practical applications, the hollow casing 110 is not limited to the cylindrical appearance of the embodiment of the FIG. 2, but can be a rectangular column shape, a circle shape, an elliptical shape or an arbitrary shape.

Figure 3:
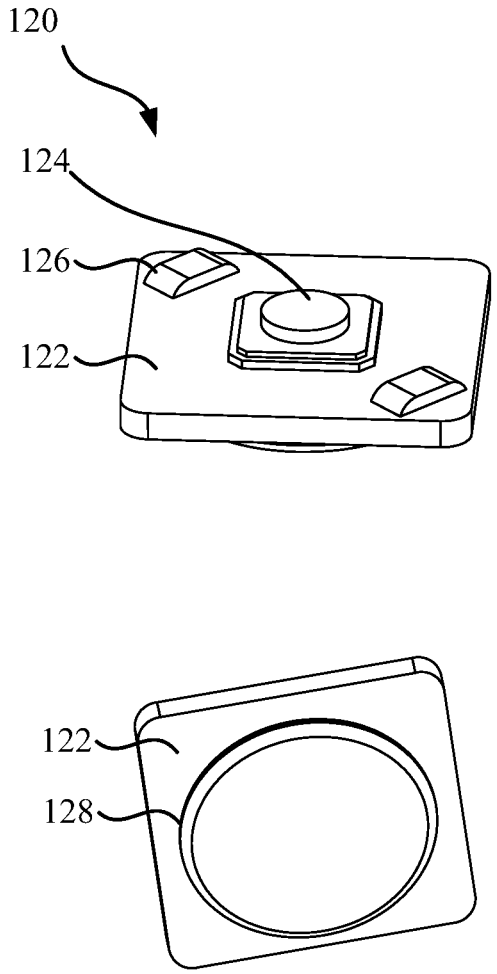
FIG. 3 is a schematic drawing illustrating a luminous device of the luminous spring buckle device according to the first embodiment of the present invention.

Please refer to FIG. 3. FIG. 3 is a schematic drawing illustrating the luminous device 120 of the luminous spring buckle device 1 according to the first embodiment of the present invention. In the first embodiment, the luminous device 120 as shown in FIG. 3 includes a circuit board 122, a controlling circuit 124, a luminous component 126 and a battery 128, wherein the controlling circuit 124 and the luminous component 126 are configured on the upper surface of the circuit board 122. The battery 128 is configured on the lower surface of the circuit board 122 for providing power to the luminous device 120. The controlling circuit 124 is connected to the luminous component 126 through the circuit board 122 to turn on and turn off of the luminous device 120. When the luminous device 120 is activated by the controlling circuit 124, the luminous component 126 emits light. In practical applications, the luminous component 126 can be, but not limited to, a plurality of LED (Light-emitting diode) in an arbitrary lighting mode such as flashing lighting, continuous lighting or fade-on lighting. In practical applications, the controlling circuit 124 includes a button and a controlling chip. The controlling chip is activated to control the luminous device 120 when the button is pressed. The button can be, but not limited to, a push button, a capacitive button, a resistive button and so on.

Figure 4:
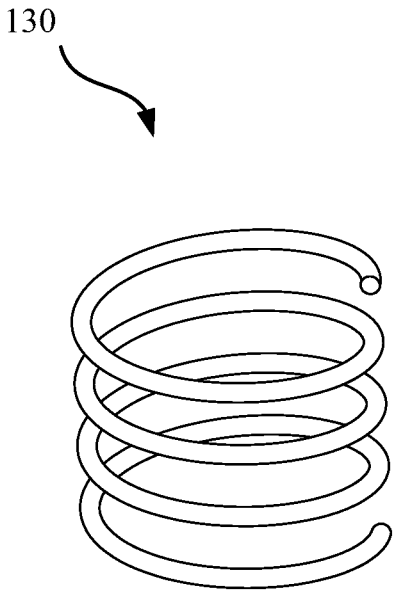
FIG. 4 is a schematic drawing illustrating an elastic device of the luminous spring buckle device according to the first embodiment of the present invention.

Please refer to FIG. 4. FIG. 4 is a schematic drawing illustrating the elastic device 130 of the luminous spring buckle device 1 according to the first embodiment of the present invention. In the first embodiment, the elastic device 130 can be a compression spring or a spring, as shown in FIG. 4. The total height of the elastic device 130 under uncompressed situation would be greater than, equal to or slightly less than the height of the hollow casing 110, and the total height of the elastic device 130 under compressed situation must be less than the height of the hollow casing 110. The material of the elastic device 130 can be iron, steel, copper, aluminum, chrome, nickel, plastic or any flexible material.

Figure 5:
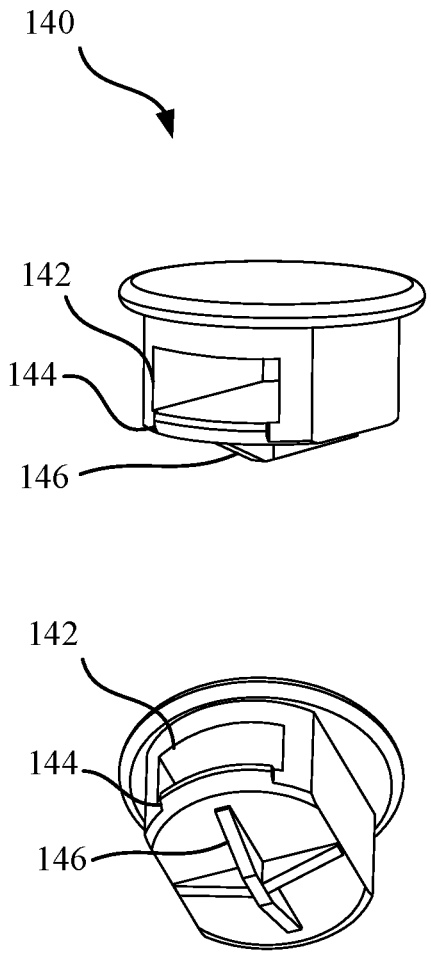
FIG. 5 is a schematic drawing illustrating a bearing device of the luminous spring buckle device according to the first embodiment of the present invention.

Please refer to FIG. 5. FIG. 5 is a schematic drawing illustrating the bearing device 140 of the luminous spring buckle device 1 according to the first embodiment of the present invention. In the first embodiment, the bearing device 130 includes a through hole 142, two tenons 144 and a conical bottom 146, as shown in FIG. 5, wherein, the upper edge of the tenon 144 forms a right angle and the lower edge of the tenon 144 forms a rounded corner to limit the engagement in one direction only. In practical applications, the conical bottom 146 is not limited to the shape of the embodiment in FIG. 5, but can be a conical, straight or any bulging shape.

Figure 6:
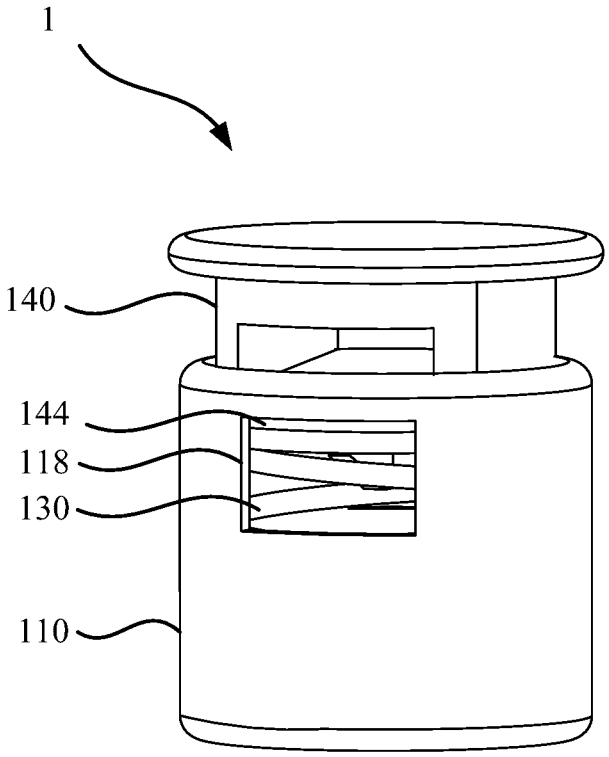
FIG. 6 is an assembly schematic drawing illustrating the luminous spring buckle device according to the first embodiment of the present invention.

Please refer to FIG. 1 and FIG. 6. FIG. 6 is an assembly schematic drawing illustrating the luminous spring buckle device 1 according to the first embodiment of the present invention. In the first embodiment, FIG. 6 shows the assembly of all parts in the exploded drawing of FIG. 1. At first, the luminous device 120 is placed to the bottom 112 of the hollow casing 110 with the battery 128 facing downward. Next, the elastic device 130 is placed into the hollow casing 110 and placed on the luminous device 120. Finally, the tenons 146 of the bearing device 140 are pressed toward the side openings 118 of the hollow casing 110 to assemble the hollow casing 110 and the bearing device 140. Please refer to FIG. 6, two tenons 146 are configured respectively inside the side openings 118 of the hollow casing 110 in a sliding manner to limit the bearing device 140 to the upper opening 114 of the hollow casing 110. Because the elastic device 130 is placed in the hollow casing 110, the bearing device 140 is lifted upward by the support of the elastic device 130 when the bearing device 140 is inserted to the hollow casing 110. Meanwhile, the tenons 146 are blocked by the upper edge of the side openings 118 to limit the bearing device 140 not to be separated from the hollow casing 110.

Figure 7:
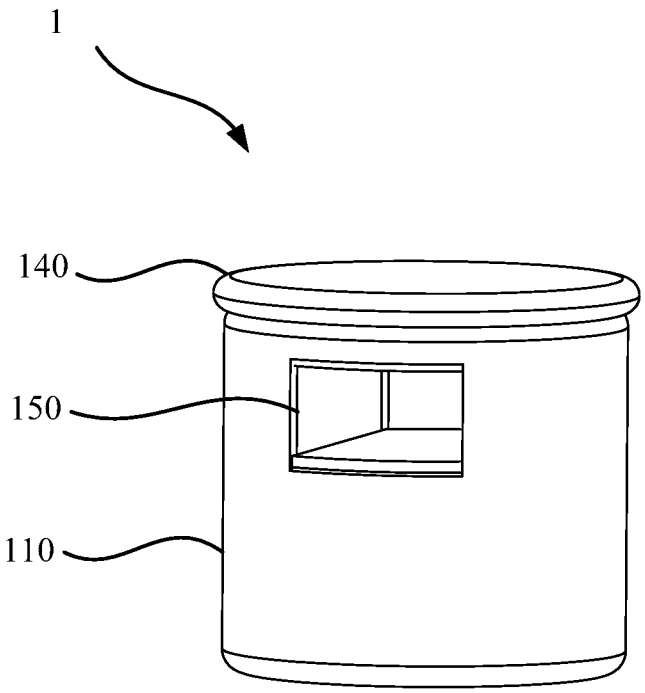
FIG. 7 is a schematic drawing illustrating the passage of the luminous spring buckle device according to the first embodiment of the present invention.

Please refer to FIG. 7. FIG. 7 is a schematic drawing illustrating the passage 150 of the luminous spring buckle device 1 according to the first embodiment of the present invention. In one embodiment, an external force is applied on the bearing device 140 which is assembled of the luminous spring buckle device 1, and the bearing device 140 compresses the elastic device 130 and enables the conical bottom 146 to compress the controlling circuit 124 of the luminous device 120. Under this situation, the through hole 142 of the bearing device 140 is corresponding to the side openings 118 of the hollow casing 110 to form a passage 150. When the external force is removed, the elastic device 130 is back to the original position by the support of the bearing device 140 (back to the situation in FIG. 6), and the conical bottom 146 uncompresses the controlling circuit 124 to enable the controlling circuit 124 to activate the luminous device 120 to cause the luminous component 126 to emit light. During the process of removing the external force, the through hole 142 and the side openings 118 are gradually separated from each other to make the passage 150 gradually smaller, and the passage 150 is closed when the bearing device 140 is back to the original position. In the above embodiment, the controlling circuit 124 is activated when the conical bottom 146 uncompressed the controlling circuit 124. However, in practical applications, the controlling circuit 124 also can be activated when the conical bottom 146 contacts the controlling circuit 124. In practical applications, when the external force is applied to the bearing device 140 again, the bearing device 140 presses the controlling circuit 124 (the luminous component 126 is in the lighting state) to enable the controlling circuit 124 to close the luminous device 120 to cause the luminous component 126 to stop lighting.

Please refer to FIG. 5, FIG. 6 and FIG. 7. In one embodiment, the passage 150 can be configured for a rope to pass through, and the rope can be any soft object such as a shoelace, a clothing tether, a backpack drawstring or a drawstring rope. In one embodiment, the luminous string buckle device 1 in the state of FIG. 7, the passage 150 is opened and a portion of the rope is capable to be accommodated in the passage 150 when the external force is applied to the bearing device 140. The volume of the passage 150 is gradually decreased to cause the portion of the object contained in the passage 150 is clamped by the shear force formed between the side openings 118 and the through hole 142 when the external force is removed, so that the relative positions of the luminous string buckle device 1 and the rope between each other are fixed.

In practical applications, the luminous string buckle device 1 of the resent invention is applied to the drawstring of the mountaineering backpack. When the climber enters the mountain or the sky is getting dark, the climber turns on the luminous string buckle device 1 to make it flicker to improve the safety. In practical applications, the luminous string buckle device 1 of the resent invention is applied to the shoelace of the sport shoes. When the user exercises at night, the user turns on the luminous string buckle device 1 to make it flicker as a warning light.

Figure 8:
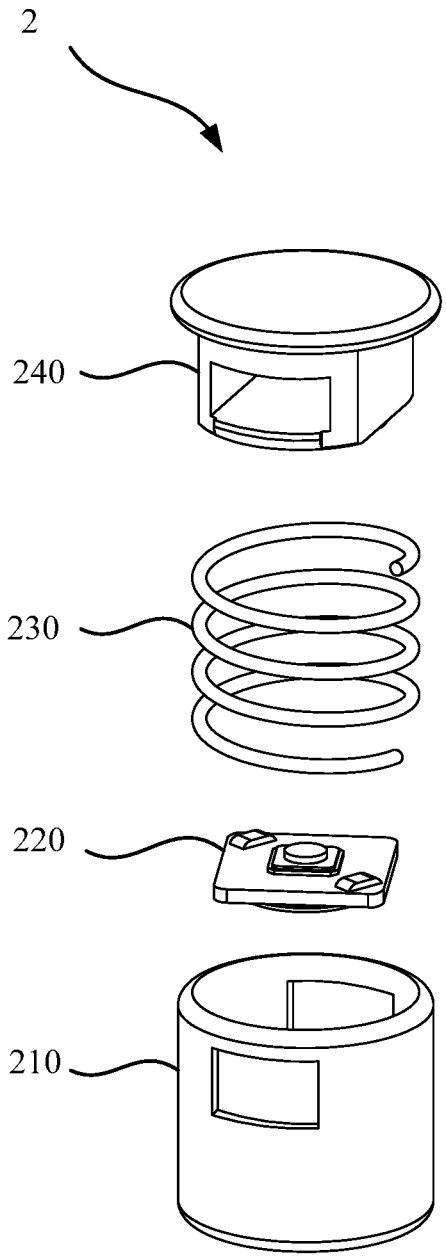
FIG. 8 is an exploded drawing illustrating a luminous spring buckle device according to the second embodiment of the present invention.
Figure 9:
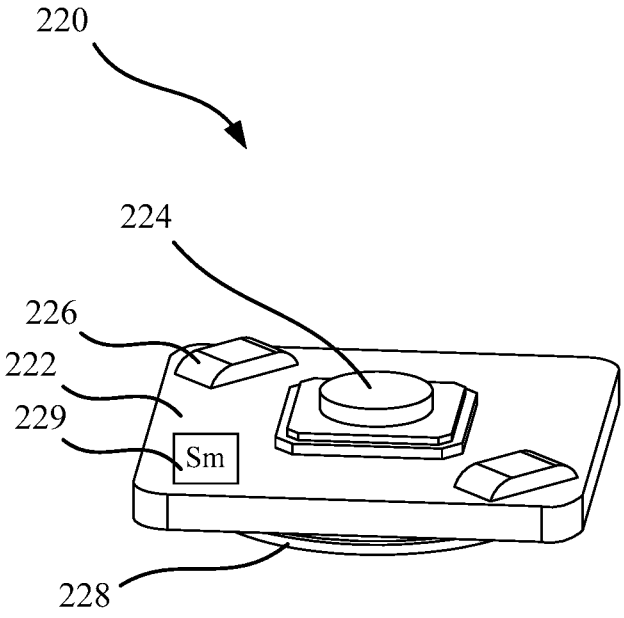
FIG. 9 is a schematic drawing illustrating a luminous device of the luminous spring buckle device according to the second embodiment of the present invention.

Please refer to FIG. 8 and FIG. 9. FIG. 8 is an exploded drawing illustrating a luminous spring buckle device 2 according to the second embodiment of the present invention. FIG. 9 is a schematic drawing illustrating a luminous device 220 of the luminous spring buckle device 2 according to the second embodiment of the present invention. In the second embodiment of the present invention, the luminous string buckle device 2 of the present invention includes a hollow casing 210, a luminous device 220, an elastic device 230 and a bearing device 240; wherein, the functions of the hollow casing 210, the elastic device 230 and the bearing device 240 are the same as those of the first embodiment. The luminous device 220 includes a circuit board 222, a controlling circuit 224, a luminous component 226, a battery 228 and a sensing module 229. The controlling circuit 224 includes a button and a controlling chip for turning on or turning off the luminous device 220. The sensing module 229 is configured for controlling the luminous component 226. The battery 228 is configured for providing the power which the luminous device 220 required.

Figure 10:
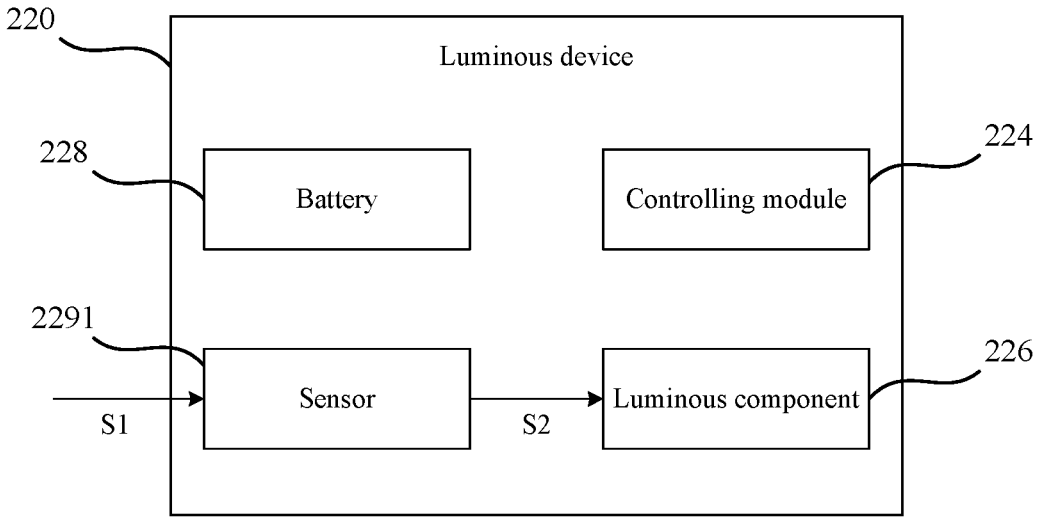
FIG. 10 is a functional block drawing illustrating a luminous device of the luminous spring buckle device according to the first sub-embodiment of the second embodiment of the present invention.

Please refer to FIG. 10. FIG. 10 is a functional block drawing illustrating the luminous device 220 of the luminous spring buckle device 2 according to the first embodiment of the second embodiment of the present invention. In the first embodiment, the sensing module 229 is a sensor 2291, and the sensor 2291 is configured to detect an environment signal S1 in the environment, converts the analog environment signal S1 into a digital controlling signal S2, and then controls the luminous component 226 using the controlling signal S2. When the luminous component 226 is activated by the controlling circuit 224, the luminous component 226 receives the controlling signal S2 from the sensor 2291 and emits light according the controlling signal S2. The sensor 2291 can be, but not limited to, a vibration sensor, a sound sensor, a light sensor and the like. In practical applications, the sensor 2291 is a vibration sensor, and when a vibration is applied to the luminous string buckle device, the vibration sensor detects a vibration signal (environment signal S1), and converts the analog vibration signal (environment signal S1) into the digital controlling signal S2 to the luminous component 226. The luminous component 226 emits light according to the intensity and the frequency of the controlling signal S2. In practical applications, the sensor 2291 is a sound sensor, and when the sound sensor detects a sound signal (environment signal S1), the sound sensor converts the analog sound signal (environment signal S1) into the digital controlling signal S2 to the luminous component 226. The luminous component 226 emits light according to the intensity and the frequency of the controlling signal S2. In practical applications, the sensor 2291 can be a light sensor, and when the light sensor detects the ambient light is insufficient, the light sensor sends the controlling signal S2 to control the luminous component 226 to emit light.

Figure 11:
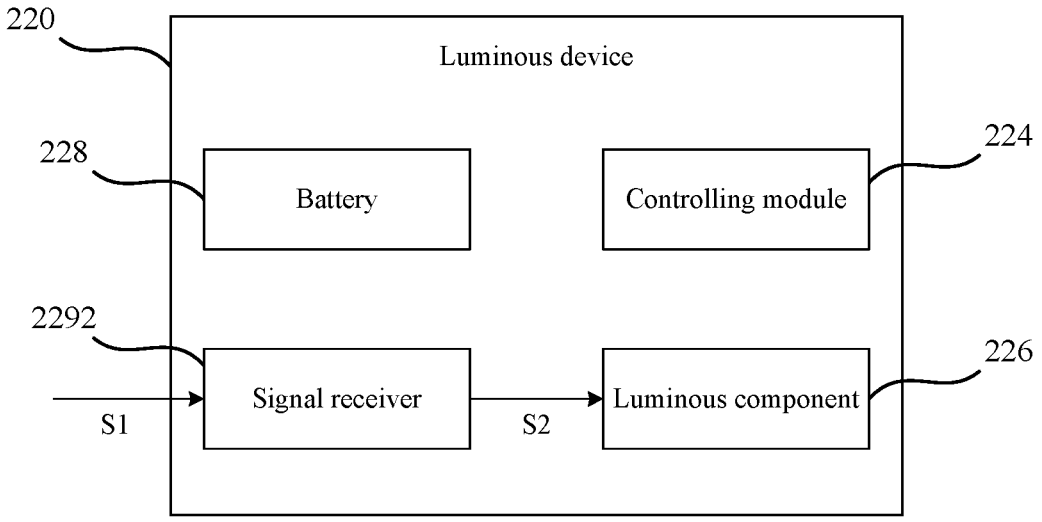
FIG. 11 is a functional block drawing illustrating another luminous device of the luminous spring buckle device according to the second sub-embodiment of the second embodiment of the present invention.

Please refer to FIG. 11. FIG. 11 is a functional block drawing illustrating the luminous device 220 of the luminous spring buckle device 1 according to the second embodiment of the second embodiment of the present invention. In the second embodiment, the sensing module 229 is a signal receiver 2292. A user can connect to the luminous device 220 through an application program of a mobile device, and choose the required luminous mode on the application program, such as flashing lighting, lighting with songs, or user-edited lighting patterns. The selected luminous mode is packaged into a command signal S3 and transmitted to the signal receiver 2292. After receiving the command signal S3, the signal receiver 2292 translates the command signal S3 into the controlling signal S2 and controls the luminous component 226. In practical applications, the command signal S3 can be an analog signal and the signal receiver 2292 translates and converts the analog signal into the digital controlling signal S2. In practical applications, the command signal S3 can be a digital signal, and the signal receiver 2292 directly converts into the controlling signal S2 after receiving the digital signal.

Figure 12:
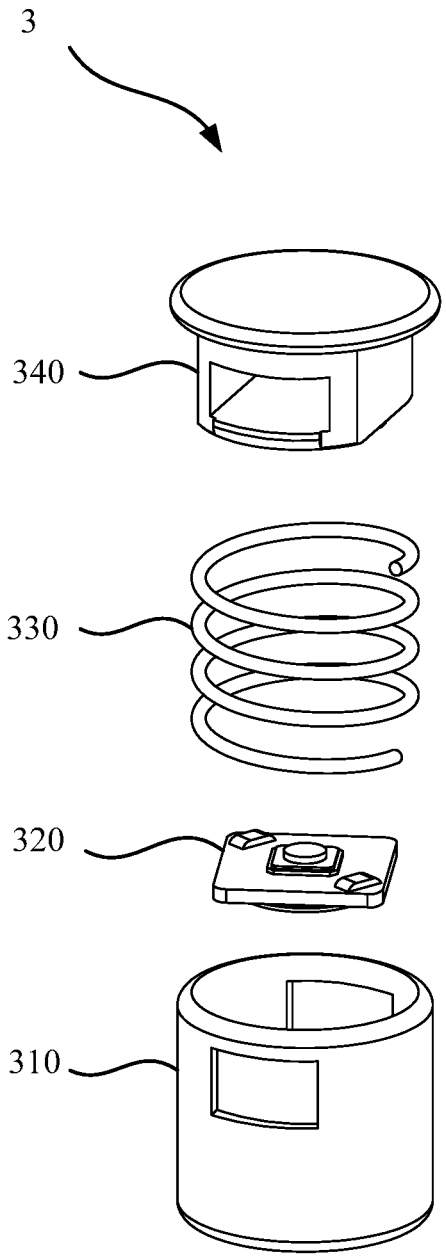
FIG. 12 is an exploded drawing illustrating a luminous spring buckle device according to the third embodiment of the present invention.
Figure 13:
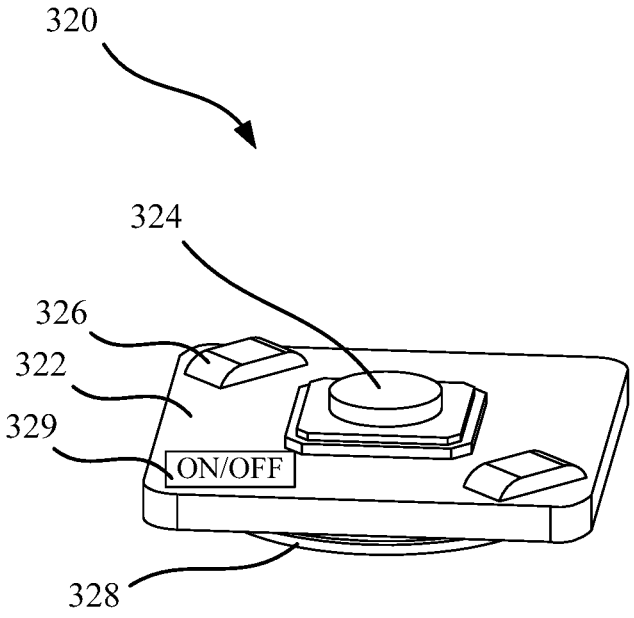
FIG. 13 is a schematic drawing illustrating a luminous device of the luminous spring buckle device according to the third embodiment of the present invention.

Please refer to FIG. 12 and FIG. 13. FIG. 12 is an exploded drawing illustrating a luminous spring buckle device 3 according to the third embodiment of the present invention. FIG. 13 is a schematic drawing illustrating a luminous device 320 of the luminous spring buckle device 3 according to the third embodiment of the present invention. In the third embodiment of the present invention, the luminous spring buckle device 3 of the present invention includes a hollow casing 310, a luminous device 320, an elastic device 330 and a bearing device 340; wherein, the functions of the hollow casing 310, the elastic device 330 and the bearing device 340 are the same as those of the first embodiment. The luminous device 320 includes a circuit board 322, a controlling circuit 324, a luminous component 326, a battery 328 and an activating component 329. The activating component 329 is configured for turning on or turning off the luminous device 320. The controlling circuit 324 includes a button and a controlling chip for controlling the luminous mode of the luminous component 326. The battery 328 is configured for providing the power of the luminous device 320.

Figure 14:
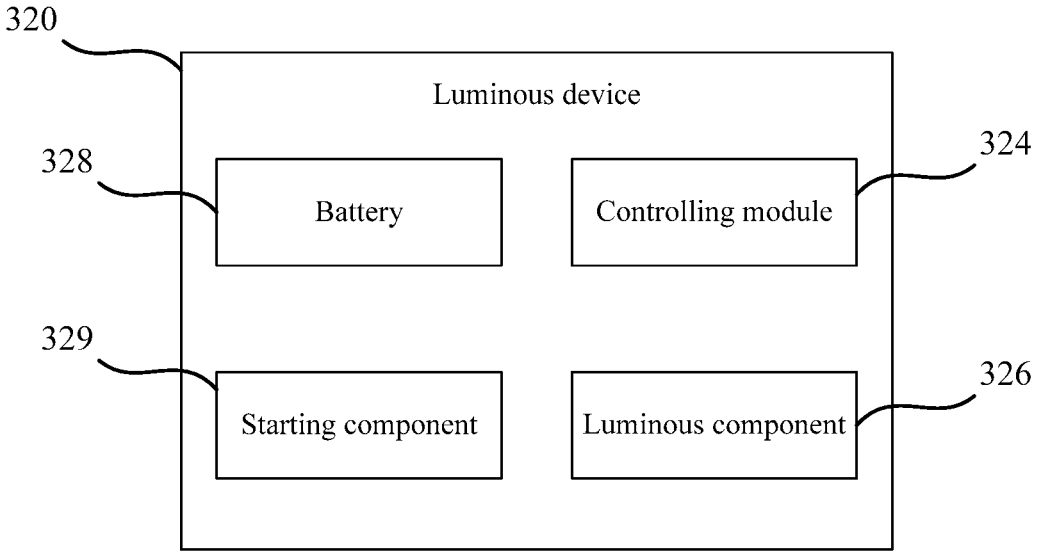
FIG. 14 is a functional block drawing illustrating the luminous device of the luminous spring buckle device according to the third embodiment of the present invention.

Please refer to FIG. 14. FIG. 14 is a functional block drawing illustrating the luminous device 320 of the luminous spring buckle device 3 according to the third embodiment of the present invention. In the third embodiment, the user turns on or turns off the luminous device 320 through the activating component 329. Wherein, the activating component 329 can be an entity switch or a virtual switch. The entity switch such as a toggle switch can be configured on the sidewall or the bottom of the hollow casing 310 to provide the user to turn on or turn off the luminous device 320. The virtual switch such as a remote control switch can be configured for the user to remotely turn on or turn off the luminous device 320 through a controller. The luminous component 326 generates a light when the luminous device 320 is activated, and the user can press the controlling circuit 324 through the bearing device 340. Moreover, the luminous mode of the luminous component 326 will be changed by pressing the controlling circuit 324 each time. The changing manner of the luminous mode can be, but not limited to, the color change, lighting frequency change, or color and frequency change. Wherein, the changing rule of the luminous mode can be written into the luminous device 320 by the program in advance.

Compared with the prior art, the luminous spring buckle device of the present invention installs a luminous device inside the spring. When the user presses the spring buckle, the bearing device presses the controlling circuit of the luminous device to enable the luminous device to emit light. Compared with the conventional spring buckle, the present invention retains the basic function of the spring buckle and adds lighting function to increase recognizability. Moreover, the luminous spring buckle device further includes the safety warning function to increase the safety in the night time.

The features and spirits of the present invention are hopefully described more clearly by the above detailed description of the preferred embodiments, and the scope of the present invention is not limited by the preferred embodiments disclosed above. On the contrary, the purpose is to cover a variety of changes and equivalence arrangements within the scope of the patent application to be applied for by the creative institute. Although the present invention has been disclosed in the above embodiments, it is not intended to limit the present invention, and anyone skilled in the art can make various changes and refinements without departing from the spirit and scope of the present invention. Therefore, the scope of protection of this present invention is subject to the definition of the scope of the patent application attached.

What is claimed is:

1. A luminous spring buckle device, comprising:
- a hollow casing comprising a bottom and a sidewall, and comprising an upper opening and two side openings corresponding to each other;
- a luminous device positioned in the hollow casing, the luminous device comprising a controlling circuit and a luminous component, the controlling circuit configured for activating the luminous device to enable the luminous component to emit light;
- an elastic device contained in the hollow casing; and
- a bearing device comprising a through hole, the bearing device engaged with the upper opening in a vertically sliding manner and coupled to the elastic device;
- wherein, when an external force is applied on the bearing device, the bearing device compresses the elastic device to cause the through hole and the two side openings to form a passage that allows one rope to pass through, and the bearing device contacts the controlling circuit to activate the luminous device and to enable the luminous element to emit light.

2. The luminous spring buckle device of claim 1, wherein a portion of the rope is capable to be accommodated in the passage when the external force is applied, and the rope is clamped in the passage when the external force is removed and then the through hole is separated from the two side openings, resulting in the decreasing of the volume of the passage.

3. The luminous spring buckle device of claim 1, wherein the bearing device comprises two tenons and the two tenons are respectively configured in the side openings of the hollow casing in a sliding manner for limiting the bearing device to the upper opening; when the external force is removed, the bearing device is lifted upwards and the two tenons are blocked by the upper edge of the two side openings to limit the bearing device to the upper opening.

4. The luminous spring buckle device of claim 1, wherein the luminous component is a light-emitting diode (LED), and the luminous element emits light according to a flashing lighting mode.

5. The luminous spring buckle device of claim 1, wherein the total length of the elastic device under an uncompressed state is greater than or equal to the length of the hollow casing, and the total length of the elastic device under a compressed state is smaller than the length of the hollow casing.

6. A luminous spring buckle device, comprising:
- a hollow casing comprising a bottom and a sidewall, and comprising an upper opening and two side openings corresponding to each other;
- a luminous device positioned in the hollow casing, the luminous device comprising a controlling circuit, a sensing module and a luminous component, the controlling circuit configured for activating the luminous device, and the sensing module being configured for controlling the luminous component;
- an elastic device contained in the hollow casing; and
- a bearing device comprising a through hole, the bearing device engaged with the upper opening in a vertically sliding manner and coupled to the elastic device;
- wherein, when an external force is applied on the bearing device, the bearing device compresses the elastic device to cause the through hole and the two side openings to form a passage that allows a rope to pass through, and the bearing device contacts the controlling circuit to activate the luminous device.

7. The luminous spring buckle device of claim 6, wherein the sensing module is a sensor, the sensor detects an environment signal and converts the environment signal to a controlling signal to control the luminous component when the luminous device is activated.

8. The luminous spring buckle device of claim 6, wherein the sensing module is a signal receiver, the signal receiver receives a command signal and converts the command signal to a controlling signal to control the luminous component when the luminous device is activated.

9. The luminous spring buckle device of claim 6, wherein a portion of the rope is capable to be accommodated in the passage when the external force is applied, and the rope is clamped in the passage when the external force is removed and then the through hole is separated from the two side openings, resulting in the decreasing of the volume of the passage.

10. The luminous spring buckle device of claim 6, wherein the bearing device comprises two tenons and the two tenons are respectively configured in the side openings of the hollow casing in a sliding manner for limiting the bearing device to the upper opening; when the external force is removed, the bearing device is lifted upwards and the two tenons are blocked by the upper edge of the two side openings to limit the bearing device to the upper opening.

11. The luminous spring buckle device claim 6, wherein the total length of the elastic device under an uncompressed state is greater than or equal to the length of the hollow casing, and the total length of the elastic device under a compressed state is smaller than the length of the hollow casing.

12. A luminous spring buckle device, comprising:
- a hollow casing comprising a bottom and a sidewall, and comprising an upper opening and two side openings corresponding to each other;

a luminous device positioned in the hollow casing, the luminous device comprising a controlling circuit, an activating component and a luminous component, the activating component configured for activating the luminous device, and the controlling circuit configured for choosing a luminous mode of the luminous component;

an elastic device contained in the hollow casing; and a bearing device comprising a through hole, the bearing device engaged with the upper opening in a vertically sliding manner and coupled to the elastic device;

wherein, when an external force is applied on the bearing device, the bearing device compresses the elastic device to cause the through hole and the two side openings to form a passage that allows a rope to pass through, and the bearing device contacts the controlling circuit to change the luminous mode of the luminous component.

13. The luminous spring buckle device of claim 12, wherein the luminous mode comprises flashing lighting, continuous lighting or fade-on lighting.

14. The luminous spring buckle device of claim 12, wherein a portion of the rope is capable to be accommodated in the passage when the external force is applied, and the rope is clamped in the passage when the external force is removed and then the through hole is separated from the two side openings, resulting in the decreasing of the volume of the passage.

15. The luminous spring buckle device of claim 12, wherein the bearing device comprises two tenons and the two tenons are respectively configured in the side openings of the hollow casing in a sliding manner for limiting the bearing device to the upper opening; when the external force is removed, the bearing device is lifted upwards and the two tenons are blocked by the upper edge of the two side openings to limit the bearing device to the upper opening.

16. The luminous spring buckle device of claim 12, wherein the total length of the elastic device under an uncompressed state is greater than or equal to the length of the hollow casing, and the total length of the elastic device under a compressed state is smaller than the length of the hollow casing.

* * * * *